US005901555A

United States Patent [19]

Mandai et al.

[11] Patent Number: 5,901,555

[45] Date of Patent: May 11, 1999

[54] GAS TURBINE COMBUSTOR HAVING MULTIPLE BURNER GROUPS AND INDEPENDENTLY OPERABLE PILOT FUEL INJECTION SYSTEMS

[75] Inventors: Shigemi Mandai; Hitoshi Kawabata; Koichi Nishida, all of Hyogo-ken, Japan

[73] Assignee: Mitsubishi Heavy Industries, Ltd., Tokyo, Japan

[21] Appl. No.: 08/846,643

[22] Filed: Apr. 30, 1997

[51] Int. Cl.[6] ..... F02C 7/26

[52] U.S. Cl. ..... 60/747; 60/737; 60/39.826

[58] Field of Search ..... 60/732, 733, 737, 60/738, 739, 746, 747, 760, 742, 39.826

[56] References Cited

U.S. PATENT DOCUMENTS

| | | | |
|---|---|---|---|
| 4,499,735 | 2/1985 | Moore et al. | 60/739 |
| 4,898,001 | 2/1990 | Kuroda et al. | 60/737 |
| 5,036,657 | 8/1991 | Seto et al. | 60/739 |
| 5,101,633 | 4/1992 | Keller et al. | 60/737 |
| 5,127,229 | 7/1992 | Ishibashi et al. | 60/747 |
| 5,199,265 | 4/1993 | Borkowicz | 60/737 |
| 5,349,812 | 9/1994 | Taniguchi et al. | 60/747 |
| 5,359,847 | 11/1994 | Pillsbury et al. | 60/737 |
| 5,361,586 | 11/1994 | McWhirter et al. | 60/737 |
| 5,373,694 | 12/1994 | Clark | 60/747 |
| 5,394,688 | 3/1995 | Amos | 60/747 |
| 5,450,725 | 9/1995 | Takahara et al. | 60/737 |

*Primary Examiner*—Charles G. Freay
*Assistant Examiner*—Ted Kim
*Attorney, Agent, or Firm*—Alston & Bird LLP

[57] ABSTRACT

In a gas turbine combustor of the present invention, a pilot fuel nozzle is composed of at least two systems with different hole diameters, and the fuel flow rate of each system can be controlled independently. Also, even if the operation of main burners is switched in accordance with high or low load, the pilot fuel is selected accordingly. Further, the pilot fuel differential pressure is kept high to effect stable supply of fuel, and stable combustion is maintained.

6 Claims, 2 Drawing Sheets

GAS TURBINE COMBUSTOR HAVING MULTIPLE BURNER GROUPS AND INDEPENDENTLY OPERABLE PILOT FUEL INJECTION SYSTEMS

FIELD OF THE INVENTION AND RELATED ART STATEMENT

The present invention relates to a gas turbine combustor.

A conventional gas turbine combustor will be described with reference to FIG. 2.

FIG. 2(*a*) is a side sectional view of a conventional gas turbine combustor, and FIG. 2(*b*) is a front view thereof.

Reference numeral 201 denotes main burners of a first system, and 202 denotes main burners of a second system. Four of the main burners 201 and 202 each are arranged alternately in the circumferential direction, and a premixed gas of main fuel and air is formed by a total of eight burners.

A pilot fuel nozzle 203 is arranged in the center of the aforesaid main burners 201 and 202, so that the premixed gas is burned in a combustor 204 by using the fuel supplied from the pilot fuel nozzle 203 as an ignition source. The combustor 204 performs switching operation by dividing the main burners 201 and 202 into a plurality of groups in accordance with the load. Reference numeral 205 denotes a swirler for supplying pilot air for burning the pilot fuel. In FIG. 2(*a*), the arrow A indicates the supply direction of air, the arrow M indicates that of main fuel, and the arrow P indicates that of pilot fuel.

When the gas turbine load is a 40% load or less, the main fuel M is supplied only to the four main burners 201 of the first system arranged alternately. On the other hand, when the gas turbine load is higher than this value, the main fuel M is supplied to all of eight main burners 201 and 202 of both the first and second systems. The number of holes formed in the pilot fuel nozzle is eight in total to always supply the fuel so as to correspond to respective main burners 201 and 202.

In the above-mentioned conventional gas turbine combustor, the flow rate of the pilot fuel P is increased when the gas turbine load is low. For example, the ratio of pilot fuel to the total fuel flow rate is made 50% to achieve stable combustion. When the gas turbine load is high, the ratio of pilot fuel is decreased to 10%, for example, to decrease the amount of NOx.

Since the maximum supply pressure of fuel is fixed, the hole diameter of fuel nozzle is determined under a condition in which the ratio of pilot fuel is high. The hole diameter thus determined decreases the fuel differential pressure when the ratio of pilot fuel is decreased, so that it becomes difficult to effect stable fuel supply.

Also, when the gas turbine load is low, the main fuel M is supplied to only four main burners 201 of the first system, and only the air A is supplied to the other four main burners 202 of the second system. On the other hand, the pilot fuel P to the pilot fuel nozzle 203 is supplied to the positions corresponding to not only the main burners 201 of the first system but also the main burners 202 of the second system, so that the pilot flame is cooled by air at the positions corresponding to the main burners 202 of the second system, resulting in the production of CO.

Further, when the gas turbine load is high, fuel is supplied to all main burners 201 and 202 of both the first and second systems, so that the concentration of the premixed gas is high. In such a situation, if the pilot fuel P is supplied through eight injection ports of the pilot fuel nozzle 203 as in this example, the combustion becomes too vigorous, so that the combustion becomes rather unstable.

OBJECT AND SUMMARY OF THE INVENTION

The present invention was made to solve the problems with the conventional gas turbine combustor, and accordingly an object thereof is to provide a gas turbine combustor which produces exact and stable combustion.

To achieve the above object, the present invention provides a gas turbine combustor in which a plurality of main burners are arranged around a pilot fuel nozzle, and switching operation is performed by dividing the main burners into a plurality of groups in accordance with the load, characterized in that the pilot fuel nozzle is composed of at least two systems with different hole diameters, and the fuel flow rate of each system can be controlled independently, so that the supply of pilot fuel can be controlled so as to achieve a combustion state in accordance with the variations in gas turbine load, and the pilot fuel differential pressure is kept high, by which the stable supply of fuel can be effected.

Also, the present invention provides a gas turbine combustor in which the pilot fuel nozzle is composed of a system with large hole diameter and a system with small hole diameter, and the holes of the large system are arranged close to the main burners for supplying fuel so as to correspond to the main burners when the gas turbine load is not higher than a given value. Thereupon, for example, when the gas turbine load is low, pilot fuel is supplied to the positions corresponding to the main burners of a limited number, to which main fuel is supplied, and is used as an ignition source, by which the combustion is surely effected, and stable combustion is maintained.

Also, the present invention provides a gas turbine combustor in which the number of the holes of the small system of the pilot fuel nozzle is smaller than the number of the main burners. By decreasing the number of pilot fuel nozzles as compared with the number of main burners, for example, when the turbine load is high, the positions where pilot fuel is supplied and the positions where it is not supplied exist in the circumferential direction, and the flame at positions where pilot fuel is supplied is short, and the flame at positions where it is not supplied is long. Therefore, the heat rate is distributed, so that stable combustion can be maintained.

Further, the present invention provides a gas turbine combustor in which control is carried out so that fuel is supplied to the system with large hole diameter of the pilot fuel nozzle when the gas turbine load is not higher than a given value, and fuel is supplied to the system with small hole diameter when the gas turbine load is higher than a given value. Thereupon, the system with large hole diameter and the system with small hole diameter of the pilot fuel nozzle are used properly in accordance with the low or high gas turbine load, the supply of pilot fuel suitable for the combustion state following the variations in load is maintained, and the stability of combustion is enhanced.

As described above, the present invention achieves an effect that the fuel supply differential pressure is kept high despite the level of gas turbine load, so that fuel can be supplied stably.

Also, according to the invention of claim 2, when the gas turbine load is low, pilot fuel is supplied so as to correspond to the main burners to which main fuel is supplied, so that the combustion is maintained surely and stably. In addition, since pilot fuel is not supplied to the positions of main burners to which only air is supplied, the pilot flame at the positions is cooled, so that CO is not produced.

Also, the invention of claim 3 achieves an effect that when the gas turbine load is high, the flame length, that is, the heat rate distribution can be controlled, so that stable combustion can be maintained.

Further, the invention of claim 4 achieves an effect that the system with large hole diameter and the system with small hole diameter of the pilot fuel nozzle are used properly in accordance with the low or high gas turbine load, the supply of pilot fuel suitable for the variations in load is maintained, and the stability of combustion is secured.

BRIEF DESCRIPTION OF THE DRAWINGS

FIG. 1(*a*) is a side sectional view, and FIG. 1(*b*) is a front view; FIG. 2(*a*) is a side sectional view, and FIG. 2(*b*) is a front view.

DETAILED DESCRIPTION OF PREFERRED EMBODIMENTS

Figure 1A:
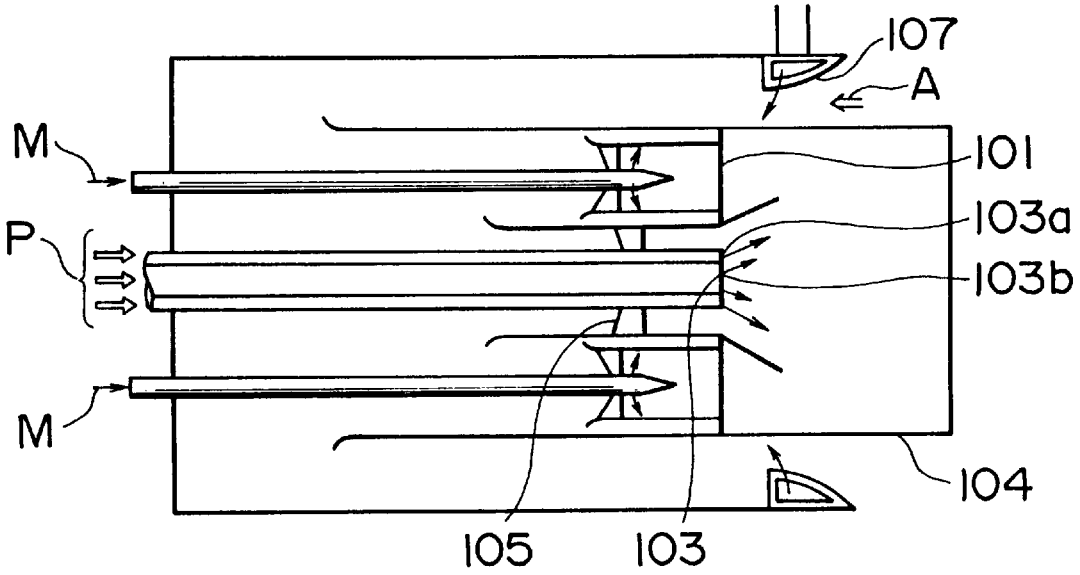
FIG. 1 shows a configuration of a gas turbine combustor in accordance with one embodiment of the present invention.
Figure 1B:
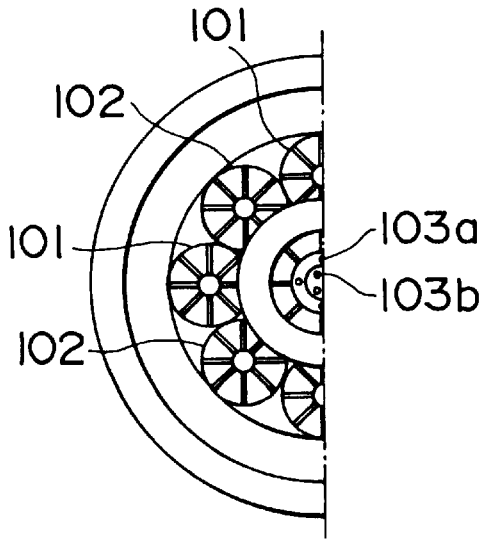
Figure 2A:
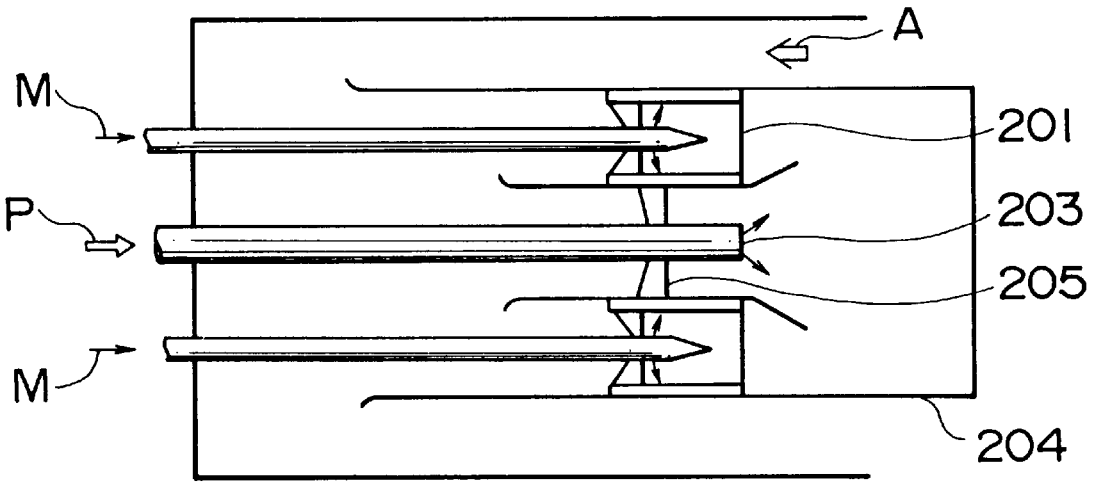
FIG. 2a RELATED ART
FIG. 2 shows a configuration of a conventional gas turbine combustor.
Figure 2B:
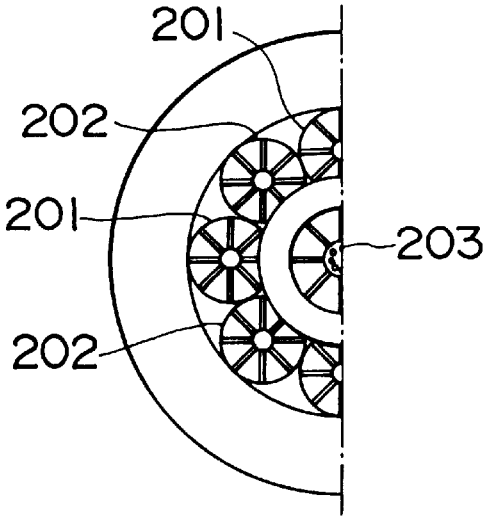
FIG. 2b RELATED ART

One embodiment of the present invention will be described with reference to FIG. 1. FIG. 1(*a*) is a side sectional view of a gas combustion combustor in accordance with the present invention, and FIG. 1(*b*) is a front view thereof.

The reference numerals of this embodiment in the figure are at the level of 100 though those of the conventional combustor are at the level of 200 to establish correspondence to each other, facilitate understanding the differences between the combustor of this embodiment and the conventional combustor, and omit duplicated explanation.

Reference numeral 101 denotes main burners of a first system extending in the axial direction, and 102 denotes main burners of a second system extending in the axial direction. Four of the main burners 101 and 102 each are arranged alternately in the circumferential direction. Reference numeral 103 denotes the whole of pilot fuel nozzle extending in the axial direction. The pilot fuel nozzle 103 is surrounded by the main burners 101 and 102 of the first and second systems and arranged in the center thereof.

The pilot fuel nozzle 103, having different hole diameters of two large and small systems, is composed of a system with a large hole diameter and a system with a small hole diameter. Holes 103*a* of the large system are arranged on the outside, and a total of four holes are formed at positions close to the main burners 101 of the first system so as to correspond to the main burners 101. Holes 103*b* of the small system are arranged on the inside, and a total of three holes are formed at positions corresponding to the main burners 102 of the second system. That is, the number of holes of the small system of the pilot fuel nozzle 103 is smaller than the number of the main burners 102 of the second system, which is four.

The holes 103*a* of the large system and the holes 103*b* of the small system have a flow path system independent of each other, and the respective flows are controlled by a not illustrated controller. Thereupon, the pilot fuel nozzle 103 is configured so that the fuel flow rate of each system can be controlled independently.

More specifically, when the gas turbine load is low and only the main burners 101 of the first system is operated, control is carried out so that the pilot fuel P is supplied to the system of large holes 103*a* corresponding to the main burners 101 of the first system and no fuel is supplied to the system of small holes 103*b*.

On the other hand, when the gas turbine load is high and all main burners 101 and 102 of the first and second systems are operated, control is carried out so that the pilot fuel P is supplied to the system of small holes 103*b* and the system of large holes 103*a* is ceased.

That is, according to this embodiment, when the gas turbine load is low, the main fuel M and the air A form a premixed gas by using four main burners 101 of the first system, and the gas is burned in a combustor 104 by using the fuel supplied from four large holes 103*a* of the pilot fuel nozzle 103 as an ignition source.

When the gas turbine load is high, the main fuel M and the air A form a premixed gas by using eight main burners 101 and 102 of the first and second systems, and the gas is burned in the combustor 104 by using the fuel supplied from three small holes 103*b* of the pilot fuel nozzle 103 as an ignition source. Reference numeral 105 denotes a swirler for supplying pilot air, which is provided to burn the pilot fuel P, and 107 denotes a fuel nozzle for supplying some fuel into the air flow.

When the gas turbine load is low, the pilot fuel P is present only at positions corresponding the main burners 101 of the first system for forming the premixed gas. At this time, the pilot fuel P is not present at positions corresponding to the main burners 102 of the second system for supplying the air A only, so that the pilot fuel is not cooled although it is cooled in the conventional combustor. Therefore, CO is not produced, and stable combustion suitable for low gas turbine load is maintained.

When the gas turbine load is high, the pilot fuel P is supplied through three small holes 103*b* only while the premixed gas is formed by using a total of eight main burners 101 and 102 of the first and second systems, so that the positions where the pilot fuel P is supplied and the positions where it is not supplied exist in the circumferential direction, and accordingly long flame and short flame are formed. Thereupon, the heat rate is distributed in the combustor 104, so that stable combustion is maintained.

Although one embodiment of the present invention shown in the figure has been described above, the present invention is not limited to this embodiment. Needless to say, the specific construction may be modified variously within the scope of the present invention.

We claim:

1. A gas turbine combustor comprising a plurality of main burners spaced apart about a circumference and arranged around a pilot fuel nozzle, said main burners being divided into at least first and second groups which are operable independently of each other and which occupy different portions of said circumference, said pilot fuel nozzle including first and second systems of pilot holes which are operable independently of each other, said first system comprising a plurality of pilot holes of a first diameter and said second system comprising a plurality of pilot holes of a second diameter smaller than said first diameter, the pilot holes of said second system being located radially inward of the first system of pilot holes.

2. A gas turbine combustor according to claim 1, wherein said pilot holes of the first system are located at circumferential positions corresponding to circumferential positions of said main burners of said first group for supplying ignition fuel for said main burners of said first group.

3. A gas turbine combustor according to claim 1, wherein the number of the holes of the second system of said pilot fuel nozzle is smaller than the number of the holes of the first system.

4. A gas turbine according to claim 1, wherein each of said main burners of said first group includes a main nozzle through which fuel is supplied when a gas turbine load is not higher than a predetermined value, and wherein the pilot holes of the first system are disposed adjacent to the main nozzles of said first group of main burners for supplying ignition fuel therefor.

5. A gas turbine combustor according to claim 4, wherein each of said main burners of said second group includes a main nozzle through which fuel is supplied when the gas turbine load is greater than said predetermined value, and wherein ignition fuel is supplied for said second group of main burners from the pilot holes of the second system.

6. A gas turbine combustor according to claim 5, wherein the number of pilot holes of the second system is smaller than the number of main nozzles of said second group.

* * * * *